US005872432A

United States Patent [19]

Beeteson

[11] Patent Number: 5,872,432

[45] Date of Patent: Feb. 16, 1999

[54] CATHODE RAY TUBE DISPLAY APPARATUS

[75] Inventor: John Beeteson, Ayrshire, United Kingdom

[73] Assignee: International Business Machines Corporation, Armonk, N.Y.

[21] Appl. No.: 849,170

[22] PCT Filed: Jun. 15, 1995

[86] PCT No.: PCT/GB95/01396

§ 371 Date: May 30, 1997

§ 102(e) Date: May 30, 1997

[87] PCT Pub. No.: WO96/17470

PCT Pub. Date: Jun. 6, 1996

[30] Foreign Application Priority Data

Dec. 2, 1994 [GB] United Kingdom ..... 9425036.2

[51] Int. Cl.[6] ..... H01J 29/58

[52] U.S. Cl. ..... 315/382.1; 348/806; 348/745

[58] Field of Search ..... 315/382, 382.1; 348/806, 745

[56] References Cited

U.S. PATENT DOCUMENTS 3,806,636 4/1974 True et al. .

*Primary Examiner*—Theodore M. Blum
*Attorney, Agent, or Firm*—Martin J. McKinley

[57] ABSTRACT

Cathode ray tube display apparatus comprises a cathode ray display tube (210) in which an electron beam spot is scanned in a raster pattern to produce an output image. Drive means (200) generates drive voltages on the focus electrode, first and second grid electrodes, and a cathode of the cathode ray tube to generate the electron beam spot in the cathode ray tube. Spot size control means (120) simultaneously varyies, in response to a spot control signal, the voltages generated on the focus electrode, first and second gird electrodes and the cathode by the drive means to vary the size of the electron beam spot in the cathode ray tube.

17 Claims, 10 Drawing Sheets

CATHODE RAY TUBE DISPLAY APPARATUS

The present invention relates to raster-scanned cathode ray tube (CRT) displays with means for reducing Moire interference.

High performance raster-scanned cathode ray tube (CRT) displays are becoming increasingly susceptible to visual performance degradation by Moire interference patterns. Factors contributing to the susceptibility of these displays includes, but are not limited to, exceptionally small electron beam spot size, finer shadow masks or aperture grilles, user controls allowing variable picture width and height, dithered pixels patterns generated by graphics user interface software for improved colour richness, a large number of possible display modes such as 640×480 and 1024×768 pixel modes, and synchronisation to wide frequency range of line and frame synchronisation (sync) signals.

Moire interference is an interference fringe pattern produced in the picture displayed on a CRT when the spatial frequency of the shadow mask or aperture grille of the CRT and the spacing between adjacent pixels of the picture are approximately equal. The "critical pixel frequency" is obtained when the pixel spacing exactly equals the spacing of adjacent phosphors dots on the CRT screen. Moire interference is particularly prevalent when uniform patterns are displayed. Such patterns are typically displayed as backgrounds to a graphical user interface. These backgrounds typically have a dithered or speckled picture content.

Previously, Moire interference has been reduced in high performance CRT displays by changing the pitch of the shadow mask. This was a practical solution because the scan dimensions were generally fixed and there were few possible applications for the display to address. Moire interference could therefore be reduced to the point where it was not noticeable. Furthermore, the electron beam spot size of the CRTs used was relatively poor compared with more modern CRTs. This aided Moire suppression.

More recent advances in CRT performance and graphics software have caused Moire interference to once again become noticeable. A further complication stems from the introduction of CRTs having a non-linear dot pitch. Moire interference affects different regions of these CRTs at different critical pixel frequencies for each individual graphics application.

The display industry in general has recognised the re-emergence of Moire interference as a problem in high performance displays and some systems have been developed to reduce the effect by increasing spot size.

EPA 557 970 describes a technique for reducing Moire interference by shifting the displayed image vertically on every alternate frame, thereby smoothing out Moire effects. The vertical shifting however increase the susceptibility of the displayed image to vertical jitter.

In general, conventional solutions cannot detect if the Moire interference conditions are present in the display device. Instead, they attempt to reduce Moire interference, whether or not it is noticeable. The operation of these systems therefore tends to degrade the overall performance of the display. In particular, picture resolution is reduced.

In accordance with the present invention, there is now provided cathode ray tube display apparatus comprising: a cathode ray display tube in which an electron beam spot is scanned in a raster pattern to produce an output image; drive means for generating drive voltages on the focus electrode, first and second grid electrodes, and a cathode of the cathode ray tube to generate the electron beam spot in the cathode ray tube; spot size control means for simultaneously varying, in response to a spot control signal, the voltages generated on the focus electrode, first and second gird electrodes and the cathode by the drive means to vary the size of the electron beam spot in the cathode ray tube; and, Moire interference detection means comprising: a band-pass filter for generating the spot control signal in response to a signal indicative of the pixel frequency of a displayed image in a direction of raster scan falling within the pass band of the filter; and filter control means for varying the centre frequency of the pass band of the filter in dependence on an active video period of the image in said direction of raster scan, the spacing of adjacent phosphor elements of the cathode ray display tube of the display in said direction of raster scan, and the scan size in said direction of raster scan.

The present invention stems from a realisation that the electron beam spot size in a CRT display can be selectively varied to reduce objectionable Moire interference without substantially impairing image quality by selectively varying the voltages applied to the focus electrode, first and second grid electrodes and the cathodes simultaneously. By varying these voltage simultaneously, image brightness can be maintained constant despite changes in spot size.

The present invention advantageously permits selective application of Moire interference counter-measures via the spot control means depending on input video conditions. Moire interference can thus be to be avoided in the displayed image without degrading the overall performance of the display.

In an embodiment of the present invention which is preferred for its simplicity and convenience, the drive means comprises a potential divider of a transformer for generating the voltages on the focus electrode and the second grid electrode and the spot size control means comprises offset means responsive to the spot control signal for varying a bias applied to the potential divider to vary the voltages on the focus electrode and the second grid electrodes. For reasons of simplicity and cost, the offset means preferably comprises a transistor for controlling the bias applied to the potential divider in response to the spot control signal.

In a particulary preferred embodiment of the present invention, there is provided a manually adjustable user control for generating the spot control signal to permit manual adjustment of the electron beam spot size. This advantageously permits a user to set the focus of the display according to personal preference. Also, because this preferred feature permits the focus to be manually adjusted by the user, the manufacturing process step of accurate adjusting the focus of the display in the factory may be omitted, thereby simplifying thL production line for manufacturing the display. Furthermore, the manual adjustment facility permits the user to compensate the focus for electrical component drift during the lifetime of the display.

Preferably, the spot control signal comprises a binary signal, the apparatus comprising a thresholding circuit connected to the output of the filter for generating a binary signal. The binary signal simplifies control of Moire interference counter-measures provided by the spot control means.

In preferred embodiments of the present invention to be described later, the filter control means comprises an arithmetic function unit for generating a control signal for varying the centre frequency of the filter according to the formula $$f = \frac{W}{T \times P},$$

where f is control signal, W is the scan size, T is the active video period, and P is the phosphor element spacing.

The arithmetic function unit preferably comprises a microprocessor. This simplifies the circuit design of the detector because one or more of the calculations in the above formula may be performed by the microprocessor under microcode control. It will be appreciated that the microprocessor may already be available in the display to perform other display control functions. Alternatively, the microprocessor may be separate to any pre-existing processor in the display and dedicated to Moire interference detection.

The apparatus may comprise determination means for determining the active video period from a raster synchronisation signal corresponding to said direction of raster scan.

For simplicity, the determination means preferably comprises: a frequency to voltage convertor for generating an output voltage level as a function of the frequency of the raster synchronisation signal; and a corrector for generating a corrected voltage level indicative of the active video period in response to the output voltage level from the convertor.

In particularly preferred embodiments of the present invention, the apparatus comprises a display data channel, such as a Video Electronic Standards Association Display Data Channel, for communicating control data between the processor and a video source, the processor being configured to obtain the active line period from the video source, which may be a personal computer for example, via the display data channel. This advantageously avoids the added circuit complication presented by the aforementioned determination means.

The apparatus preferably comprises scan detection means for determining the scan size as a function of a raster scan signal for scanning electrons beams in the CRT in said direction of raster scan.

In an especially preferred embodiment of the present invention, the direction of raster scan is parallel to the raster scan lines, the signal indicative of the pixel frequency is the input video signal, the active video period is the active line period, and the scan size is the length of the raster scan lines.

The apparatus may comprise summation means for summing red, green and blue video signals to generate the signal indicative of pixel frequency in the form of a luminance signal corresponding to the displayed image.

The arithmetic function unit may comprise an analogue multiplier for determining the product of the active line period and the phosphor spacing. The multiplier advantageously alleviates the processing load on the microprocessor associated with the multiplication required by the above-mentioned formula.

In another especially preferred embodiment of the present invention, the direction of raster scan is perpendicular to the raster scan lines, the signal indicative of the pixel frequency is the line synchronisation signal, the active video period is the active field period, and the scan size is the length of the raster field.

The apparatus may comprise a sine wave generator for generating a sine wave synchronised to the line synchronisation signal for input to the band-pass filter. This improves the response of the band-pass filter by avoiding the introduction of unwanted harmonics to the detector by the line synchronisation signal. The sine wave generator may comprise a phase-locked loop.

Viewing the present invention from another aspect there is now provided a method for varying the size of an electron beam spot in a cathode ray tube display having a cathode ray display tube in which an electron beam spot is scanned in a raster pattern to produce an output image and drive means for generating drive voltages on the focus electrode, first and second grid electrodes, and a cathode of the cathode ray tube to generate the electron beam spot in the cathode ray tube; the method comprising simultaneously varying, in response to a spot control signal, the voltages generated on the focus electrode, first and second gird electrodes and the cathode by the drive means.

Viewing the present invention from yet another aspect there is provided moire interference detection apparatus for a raster-scanned cathode ray tube display, the apparatus comprising: a band-pass filter for generating an output signal in response to a signal indicative of the pixel frequency of a displayed image in a direction of raster scan falling within the pass band of the filter; and filter control means for varying the centre frequency of the pass band of the filter in dependence on an active video period of the image in said direction of raster scan, the spacing of adjacent phosphor elements of the cathode ray display tube of the display in said direction of raster scan, and the scan size in said direction of raster scan.

Viewing the present invention from still another aspect, there is now provided a method for detecting Moire interference in a raster-scanned cathode ray tube display, the method comprising: generating an output signal in response to a signal indicative of the pixel frequency of a displayed image in a direction of raster scan falling within the pass band of a band-pass filter; and varying the centre frequency of the pass band of the filter in dependence on an active video period of the image in said direction of raster scan, the spacing of adjacent phosphor elements of the cathode ray display tube of the display in said direction of raster scan, and the scan size in said direction of raster scan.

Preferred embodiments of the present invention will now be described, by way of example only, with reference to the accompanying drawings in which.

Figure 1:
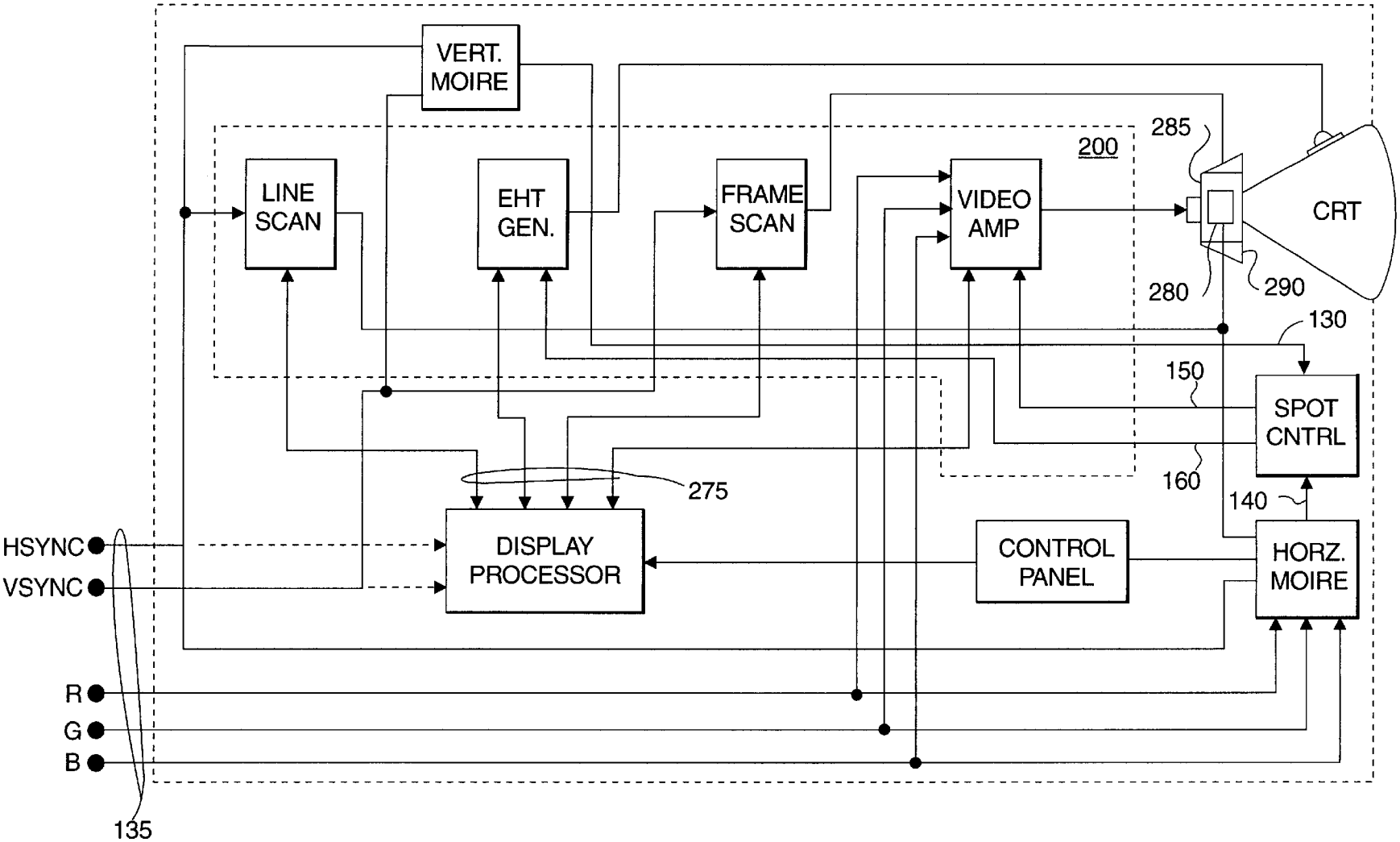
FIG. 1 is a block diagram of an example of a CRT display of the present invention.
Figure 5A:
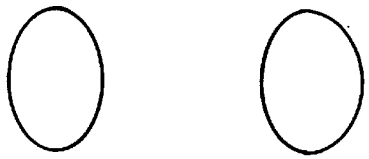
Figure 5B:
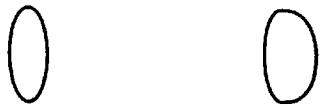
Figure 6:
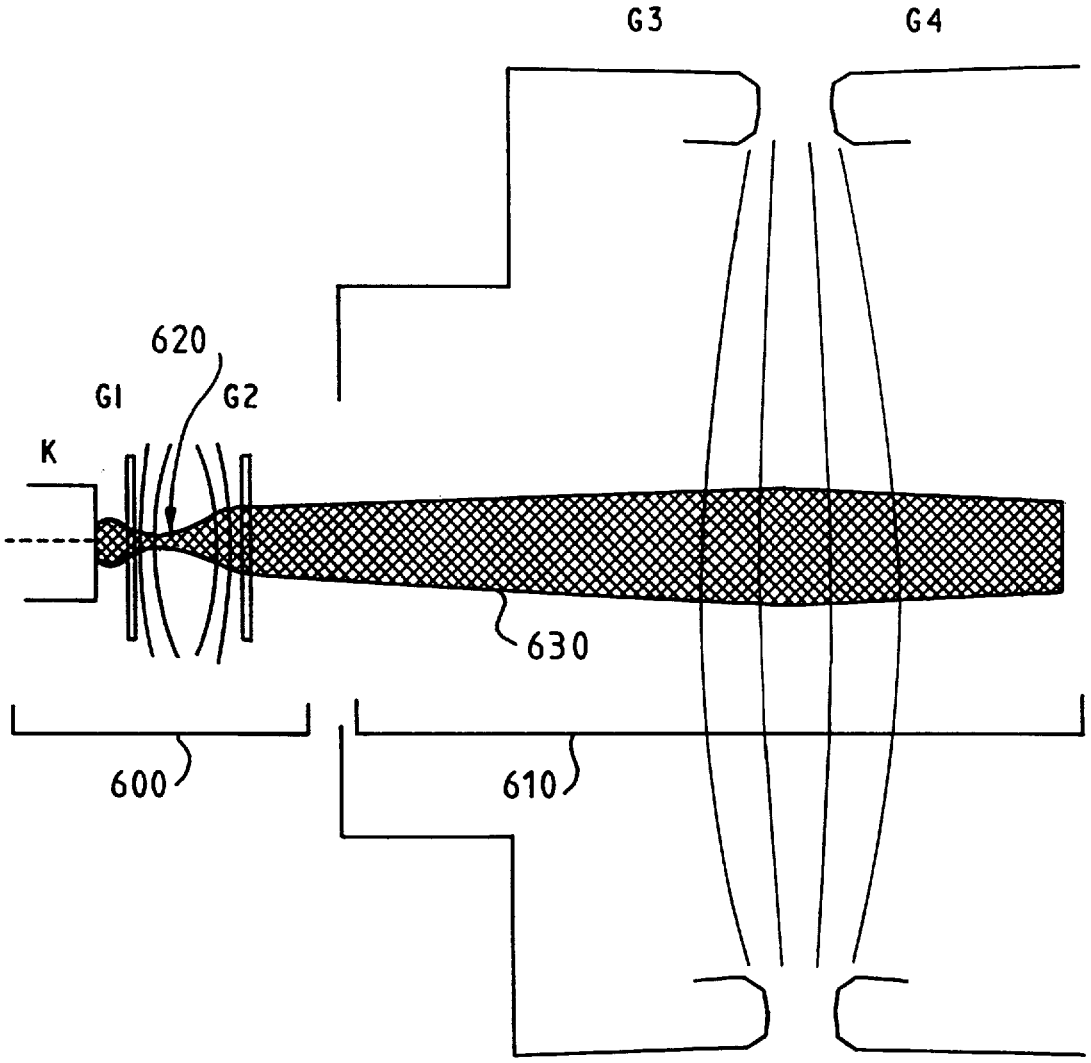
Figure 7A:
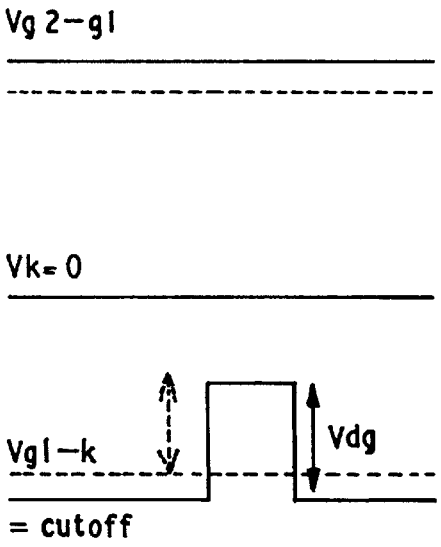
Figure 7B:
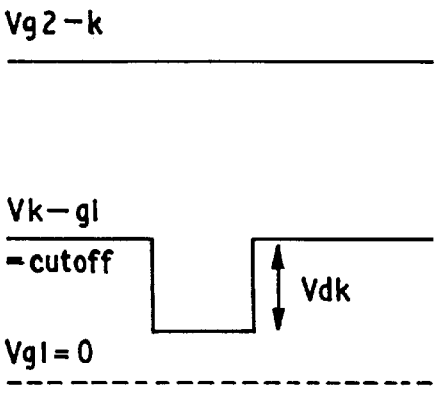
Figure 9:
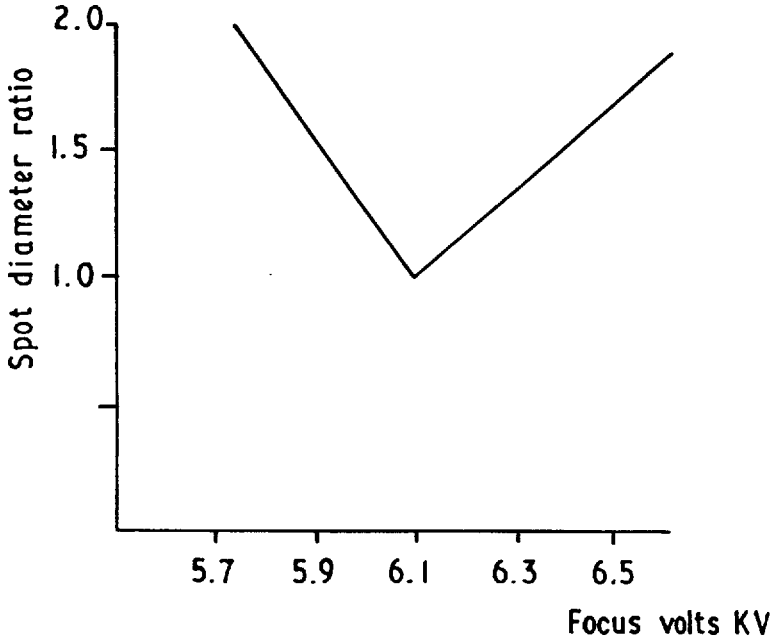
Figure 10:
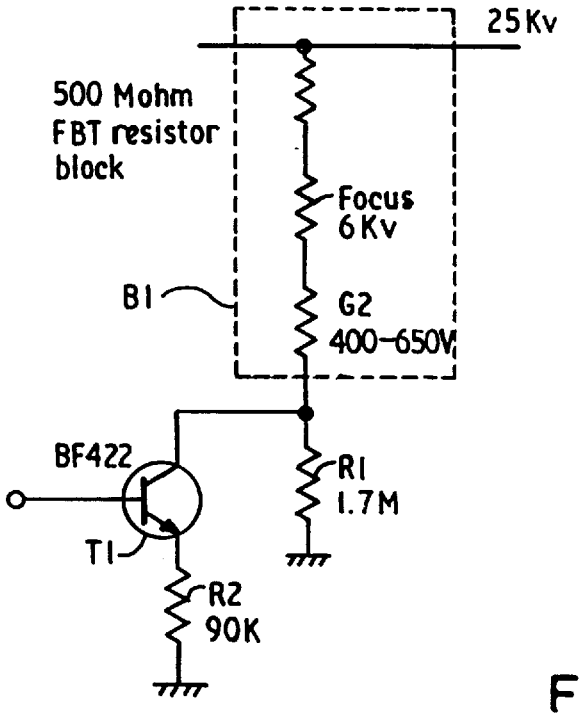
Figure 11:
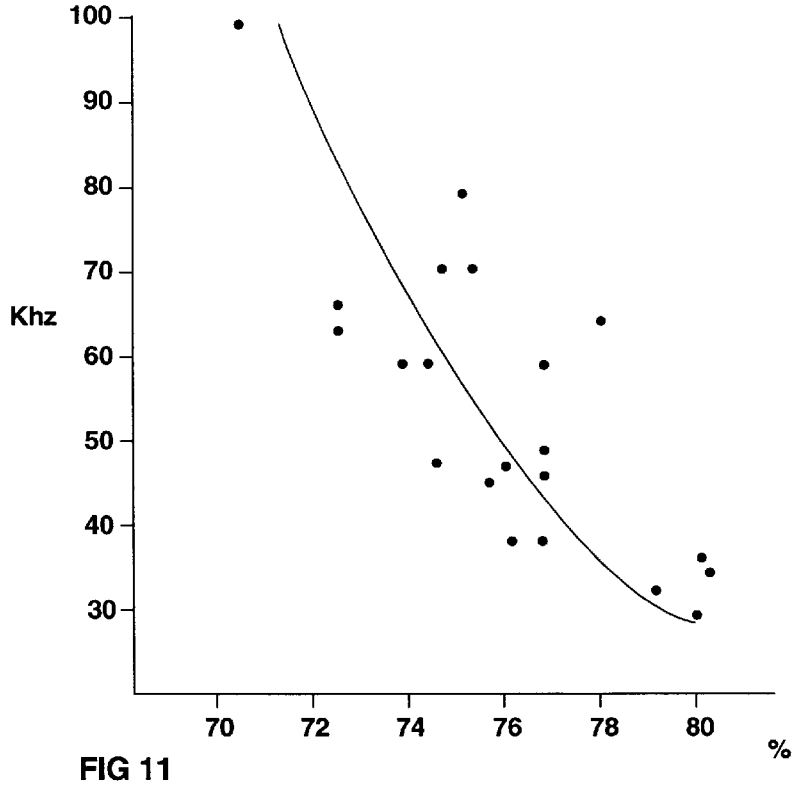
Figure 12:
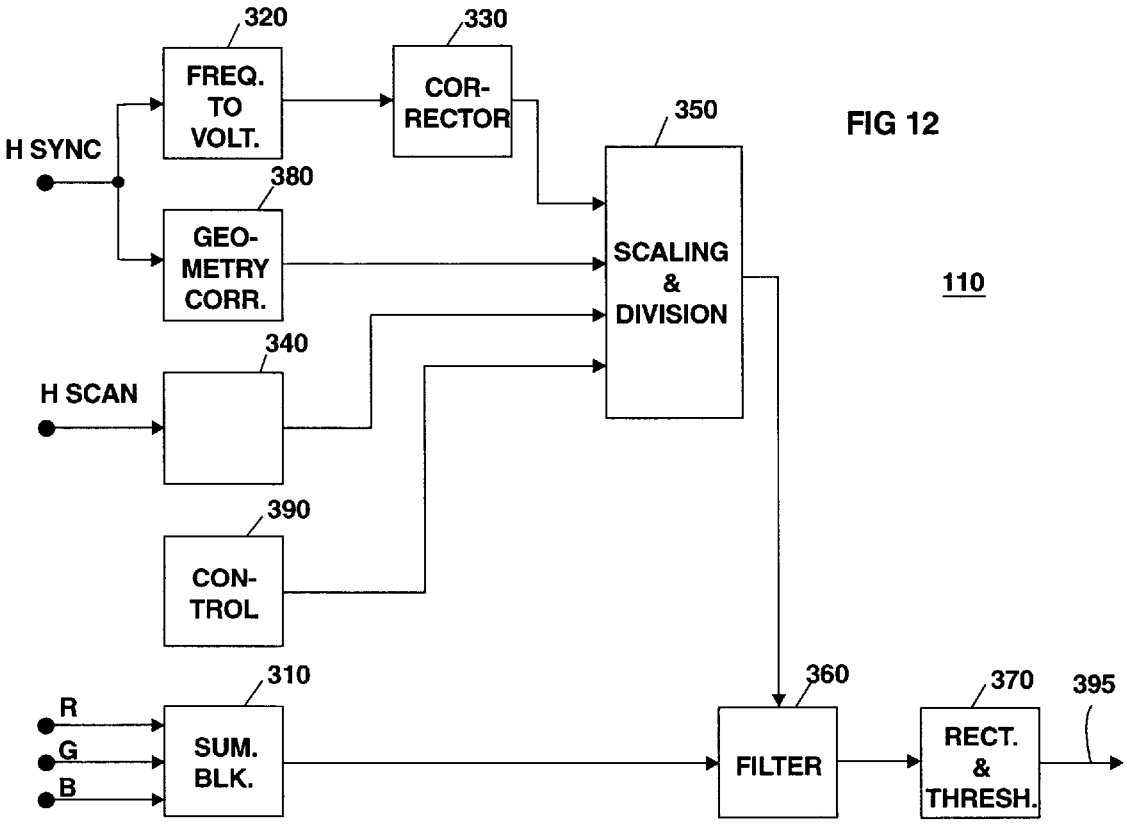
Figure 13:
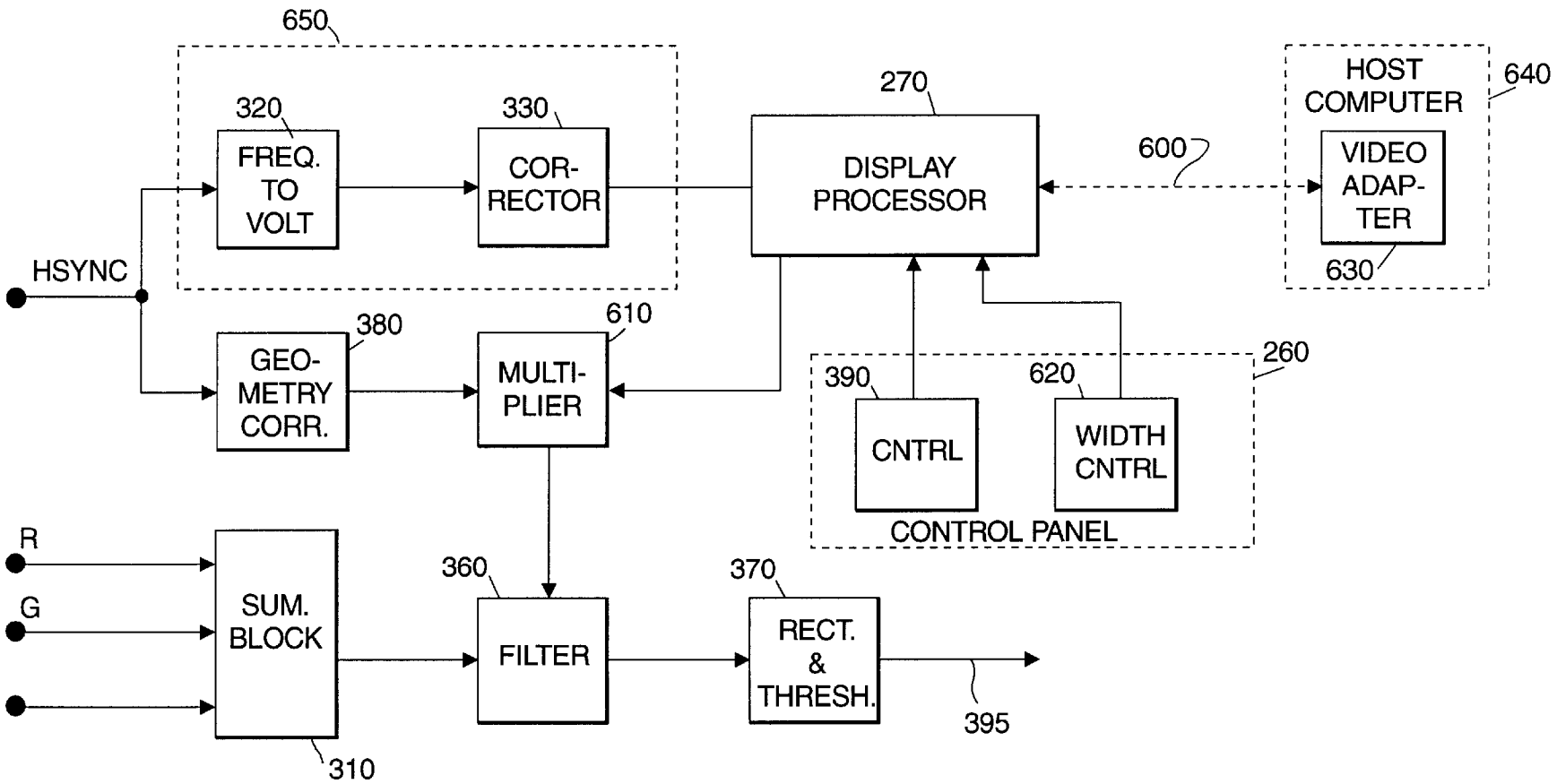
Figure 14:
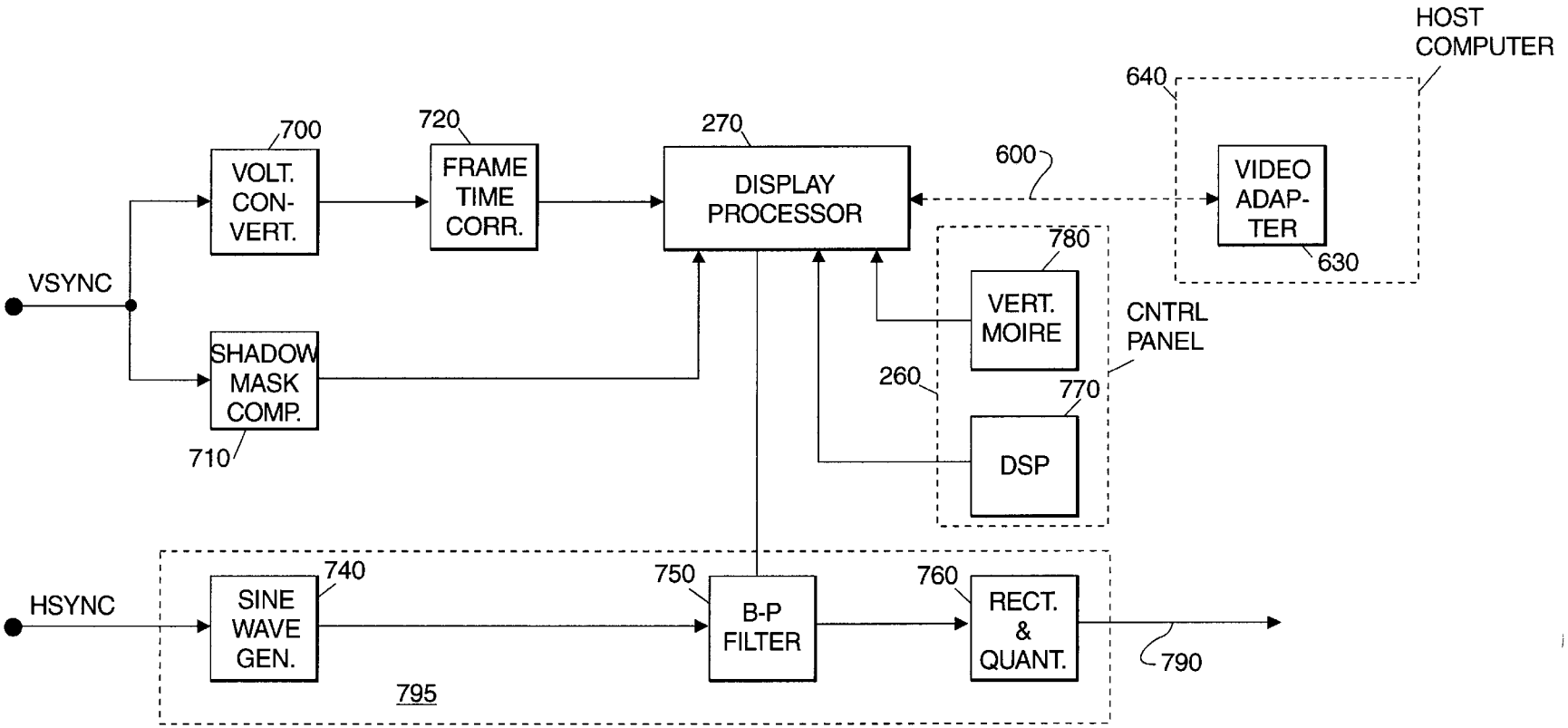

FIGS. 5A, B, and C are under-focused, focused, and over-focused electron beam spots respectively both in the centre of the CRT screen and towards the side of the CRT screen;

FIG. 6 is a block diagram of an electron gun assembly of a CRT;

FIGS. 7A, 7B and 7B are waveform diagrams relating to drive signals for driving a CRT in grid drive mode and in cathode drive mode;

FIGS. 8A to 8D are graphs of performance parameters of a typical CRT;

FIG. 9 is a graph of spot diameter in relation to focus voltage for a typical CRT;

FIG. 10 is a circuit diagram of an example of a spot control circuit for the CRT display;

FIG. 11 is a graph of line scan frequency in relation to horizontal duty cycle for a range of common display formats;

FIG. 12 is a block diagram of an example of a horizontal Moire interference detector for the CRT display;

FIG. 13 is a block diagram of another example of a horizontal Moire interference detector for the CRT display; and FIG. 14 is a block diagram of an example of a vertical Moire interference detector for the CRT display;

Referring first a FIG. 1, an example of a CRT display of the present invention comprises a colour cathode ray display tube (CRT) display screen 210. CRT 210 is connected to display drive circuitry 200. Display drive circuitry 200 comprises an Extra High Tension (EHT) generator 230 and a video amplifier 250 connected to display screen 210. Line and frame deflection coils 290 and 280 are disposed around the neck of the CRT on a yoke 320. Deflection coils 290 and 280 are connected to line and frame scan circuits 220 and 240 respectively. Line scan circuit 220 and EHT generator 230 may each be in the form of a flyback circuit, the operation of which is well known by those skilled in the art. Furthermore, as is also well-known in the art, EHT generator 230 and line scan circuit 220 may be integrated in a single flyback circuit. A power supply (not shown) is connected via power supply rails (not shown) to EHT generator 230, video amplifier 250, and line and frame scan circuits 220 and 240. In use, the power supply provides electrical power on the supply rails from Line and Neutral connections (not shown) to the domestic electricity mains supply. The power supply may be in the form of a switch mode power supply, the operation of which is well-understood by those skilled in the art.

EHT generator 230, video amplifier 250, and line and frame scan circuits 220 and 240 are each connected to a display processor 270. Display processor 270 includes a microprocessor. A user control panel 260 is provided on the front of display device 130. Control panel 260 includes a plurality of manual operable switches. User control panel is connected to key-pad interrupt lines of processor 270.

In operation, EHT generator 230 generates an electric field within CRT 210 for accelerating electrons in beams corresponding to the primary colours of red, green and blue towards the screen of CRT. EHT generator also generates focus and Grid 2 or G2 electrode voltages for driving CRT 210. Line and frame scan circuits 220 and 240 generate line and frame scan currents in deflection coils 290 and 280. The line and frame scan currents are in the form of ramp signals to produce time-varying magnetic fields that scan the electron beams across the screen of CRT 210 in a raster pattern. The line and frame scan signals are synchronised by line and frame scan circuits to input line and frame synchronisation (sync) signals HSYNC and VSYNC generated by a video source such as a personal computer system unit, for example. Video amplifier 250 modulates the red, green and blue electron beams to produce an output display on CRT 210 as a function of corresponding red, green and blue input video signals R, G and B also generated by the video source.

Display processor 270 is configured to control the outputs of EHT generator 230, video amplifier 250, and line and frame scan circuits 220 and 240 via control links 275 as functions of preprogrammed display mode data and inputs from user control 260. The display mode data includes sets of preset image parameter values each corresponding to a different popular display mode such as, for example, 1024×768 pixels, 640×480 pixels, or 1280×1024 pixels. Each set of image display parameter values includes height and centring values for setting the output of frame scan circuit 240; and width and centring values for controlling line scan circuit 220. In addition, the display mode data includes common preset image parameter values for controlling the gain and cut-off of each of the red, green and blue channels of video amplifier 250; and preset control values for controlling the outputs of EHT generator 240. The image parameter values are selected by display processor 270 in response to mode information from the video source. Display processor 270 processes the selected image parameter values to generate analog control levels on the control links.

A user can manually adjust, via user control 260, control levels sent from display processor 270 to drive circuity 250 to adjust the geometry of the displayed picture according to personal preference. User control panel 260 includes a set of up/down control keys for each of image height, centring, width, brightness and contrast. Each of the keys controls, via display processor 270, a different one or combination of the control levels, such as those controlling red green and blue video gains and cutoffs at video amplifier 250; and those controlling image width, height, and centring at line and frame scan circuits 220 and 240.

The control keys are preferably in the form of push-buttons connected to key-pad interrupt inputs 320 to display processor 270. When, for example, the width up key is depressed, user control panel 260 issues a corresponding interrupt to display processor 270. The source of the interrupt is determined by display processor 270 via an interrupt polling routine. In response to the interrupt from the width key, display processor 270 progressively increases the corresponding analog control level sent to line scan circuit 220. The width of the image progressively increases. When the desired width is reached, the user releases the key. The removal of the interrupt is detected by display processor 270, and the digital value setting the width control level is retained. The height, centring, brightness and contrast setting can be adjusted by the user in similar fashion. User control panel 260 preferably further includes a store key. When the user depresses the store key, an interrupt is produced to which display processor 270 responds by storing in memory parameter values corresponding the current settings of the digital outputs to D to A convertor as a preferred display format. The user can thus programme into display 130 specific display image parameters according to personal preference. It will be appreciated that, in other embodiments of the present invention, user control panel 260 may be provided in the form of an on-screen menu.

The CRT display also comprises, according to a preferred feature of the present invention, a Moire interference reduction system comprising a horizontal Moire interference detector 100, a vertical Moire interference detector 110, a spot control circuit 120.

Figure 2:
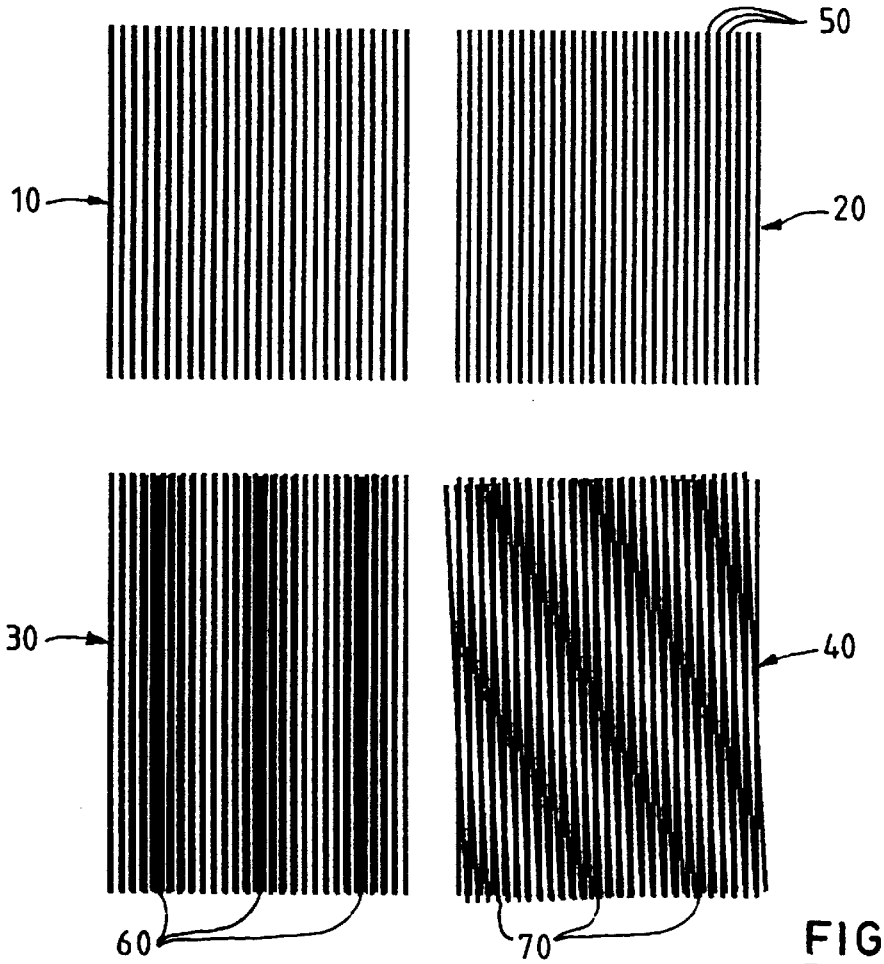
FIG. 2 is a diagram of Moire interference produced by overlapping parallel lines of slightly different spacings.

Referring now to FIG. 2, by way of example suppose CRT 210 has an aperture grille 10 comprising an array of spaced vertical mask members. A typical video pattern 20 for display on CRT 210 comprises spaced vertical lines 50. The spacing of lines 50 is slightly narrower than the pitch of aperture grille 10. When the video pattern is displayed on CRT 210, lines 50 are effectively overlaid on grille 10, as indicated at 30. Moire interference lines or fringes 60 are thus produced. However, in general, the fringes are not vertical. This is because construction tolerances and picture geometry curvatures, such as pincushion for example, tend to skew the video pattern relative to the aperture grille, as indicated at 40. Correspondingly angled Moire fringes 70 are thus produced.

Moire interference can be produced in both horizontal and vertical scan directions. In general, vertical Moire interference is more important in shadow mask CRTs and horizontal Moire interference is more important in aperture grille CRTS.

Vertical Moire interference arises from the interaction of the scan line structure with the phosphor dot structure of CRT 210. The wavelength (i.e.: the spacing) of the fringes is given by the formula below.

$$\text{Wavelength}=|2/a-N/1|^{-1}$$

where a=vertical mask pitch, 1=scan line pitch, and N=1, 2, 3 . . .

Figure 3:
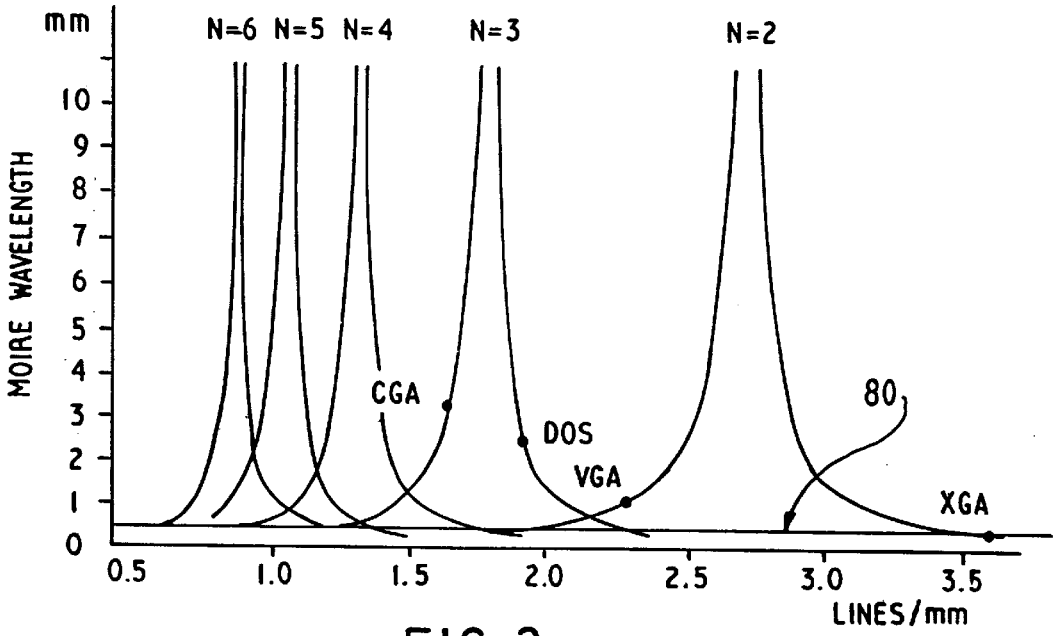
FIG. 3 is a graph of Moire interference wavelength in relation to raster line density.

The above formula is plotted in FIG. 3 for a typical high resolution colour CRT display device. For Moire interference to be visible, the wavelength must be greater than the spatial resolution of the eye which is about 30 cycles per degree at low luminance. This boundary is shown at 80 in FIG. 3 as corresponding to a wavelength of 0.3 mm.

Another requirement for Moire to be visible is that there must be sufficient modulation depth. Modulation depth is given by equation 2 below.

$$\text{Modulation depth } M=\frac{2J_1(2\cdot\text{root}\{2\cdot\text{pi}\cdot n/\text{root}3\})}{\text{root}\{2\cdot\text{pi}\cdot n/\text{root}3\}}\cdot\exp(-\text{pi}^2d^2N^2)$$

where n=shadow mask transmission coefficient (the percentage of the shadow mask occupied by holes, typically 9%), and d is the electron beam spot size.

Figure 4:
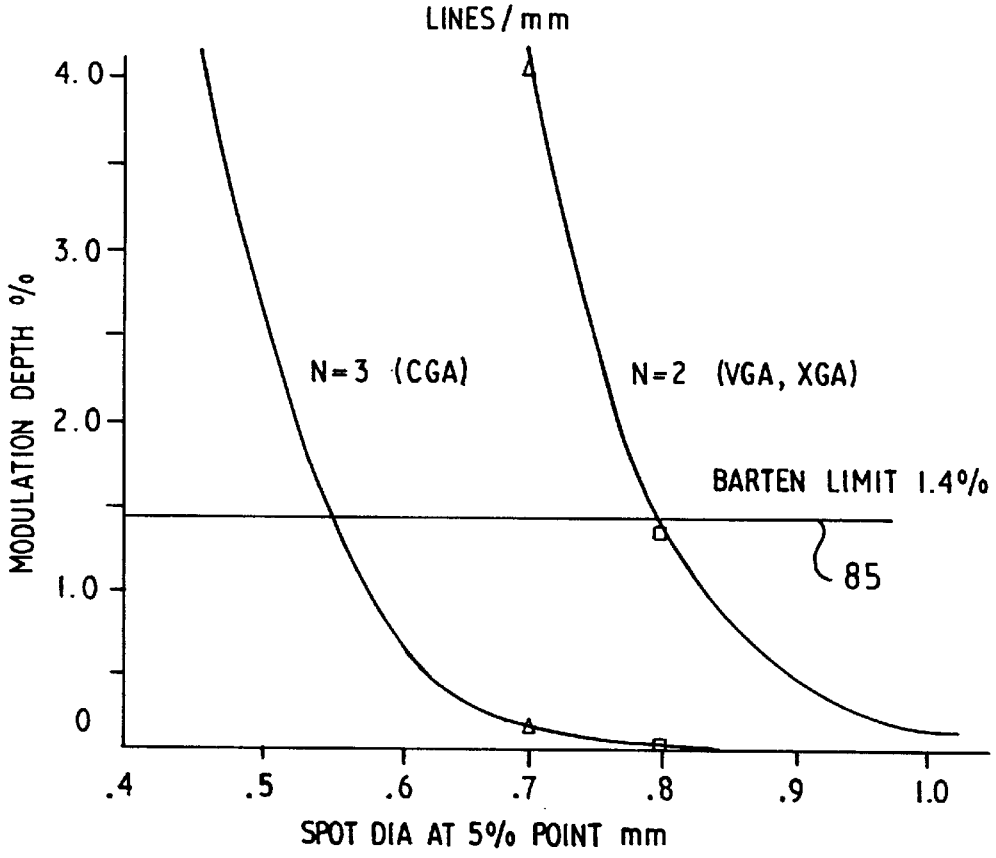
FIG. 4 is a graph of Moire interference modulation depth in relation to electron beam spot diameter.

The above formula is plotted in FIG. 4. A threshold of visibility of modulation depth is shown at 85.

Figure 5C:
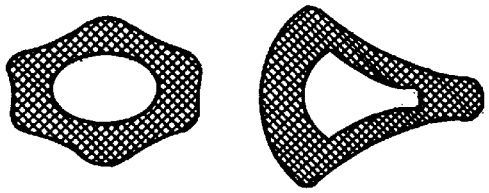

Simply changing the electron beam focal point in CRT 210 to increase electron beam spot size on the CRT screen will reduce the modulation depth and hence the visibility of Moire interference. However, automating or providing a user control with a limited adjustment range is not practical because of the high voltage (several kV) circuitry required to energise the focus lens of CRT 210. It is desirable to carefully control any defocussing on colour CRT electron guns because the electron beam spot shape off optimum focus is not symmetrical. Referring to FIG. 5*a,* the electron beam spot becomes asymmetrical towards the sides of the CRT screen. This is more noticeable when the spot is under focused or over-focused as demonstrated by FIGS. 5*a* and 5*c.* A weakening of the focus lens by reducing the focus voltage increases electron beam spot size smoothly. However, referring to FIG. 5*c,* strengthening the focus lens by increasing the focus voltage increases aberrations. This produces a halo around the spot which is visually unacceptable.

Referring now to FIG. 6, CRT 210 comprises an electron gun assembly having a triode section and a main focus lens. The triode section comprises three cathodes, and first and second gird electrodes generally referred to in the art as G1 and G2. The main focus lens comprises two focus electrodes generally referred to in the art as G3 and G4. In operation the cathodes are energised by video signals R, G and B. Triode section controls electron flow from the cathodes. A cross over image is formed between G1 and G2. According to the Hilary-Moss equations, if $I_a$=beam current, $V_c$=cut off voltage (=$V_{g1-k}$, the voltage on G1 relative to the cathode), $V_{g2}$=anode voltage (applied to G2), $V_{dg}$=drive voltage, $C_d$=crossover diameter, and $C_o$=crossover area, then:

$V_c$ is proportional to $V_{g2}$;

$I_a=3.V_{dg}^{7/2}.V_c^{-2}$;

$C_d$ is proportional to $V_{g2}^{-2}$; and $C_o$ is proportional to $V_{g2}^{-1}$.

To a reasonable approximation, the crossover area can be regarded as independent of the drive voltage. As drive voltage increases, the emitting area of the cathode changes and the angle of collection of electrons in the crossover area increases. However, the crossover area does not change. The final spot size grows because aberrations in the main focus lens become more significant as the beam angle increases. The spot area is therefore a fixed magnification of the crossover area. Because $V_{g2}$ determines the crossover area, the spot size can be controlled by varying $V_{g2}$. This can be achieved without deforming the spot with the aberrations that would be generated by varying the focus voltage.

It will also be appreciated from the above formulae that the same beam current is only maintained if $V_c$ and $V_{dg}$ are reduced in sympathy with $V_{g2}$.

Figure 7C:
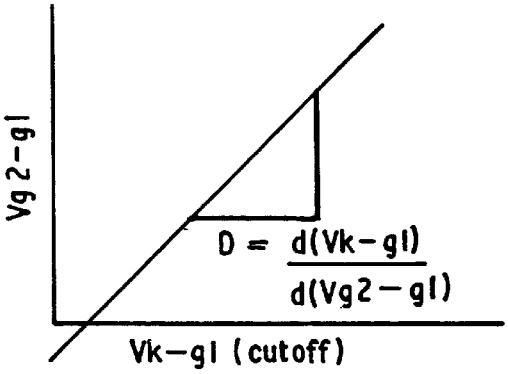
Figure 8A:
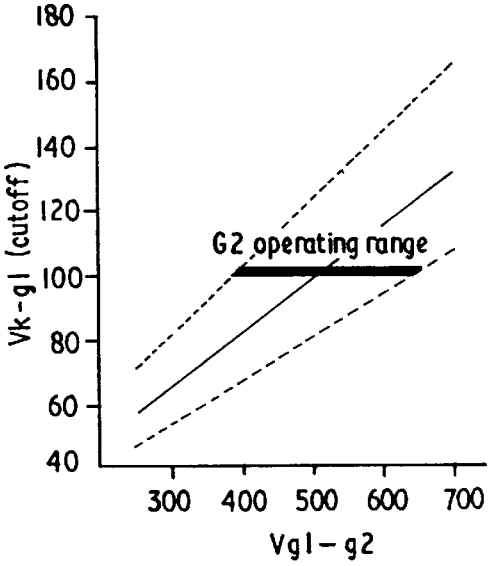
Figure 8B:
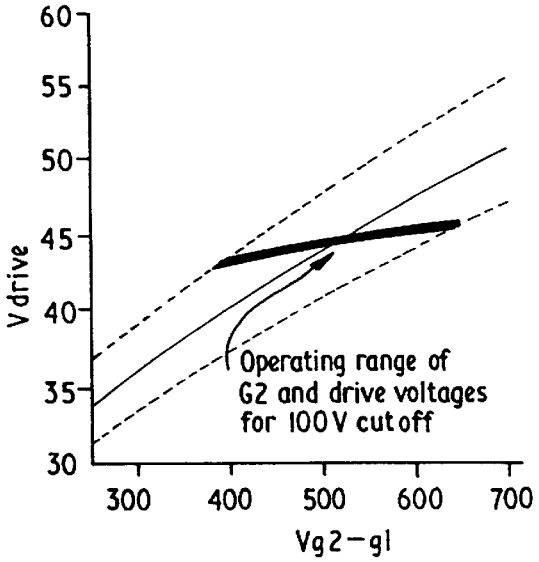
Figure 8C:
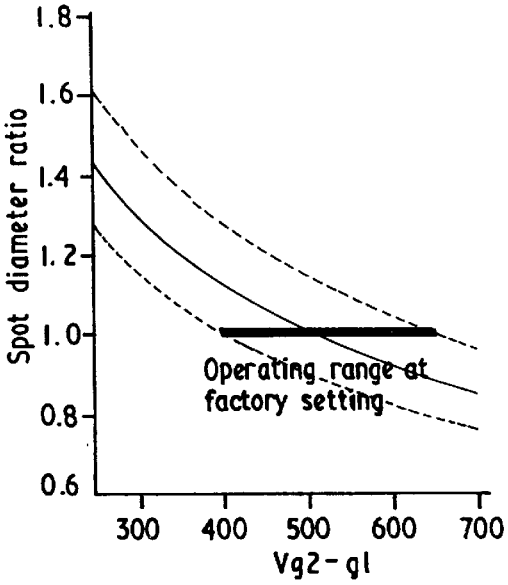
Figure 8D:
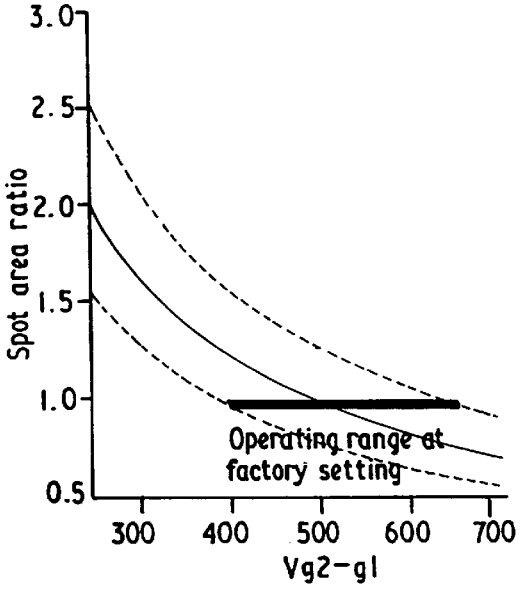

The Hilary Moss equations are directed to driving a CRT from the grids. However, it has become universal practise to drive CRTs from the cathode, holding the grids constant. The cathodes have lower capacitances and can be driven with lower video voltages. Furthermore, cathode drives permit a unitary grid structure to be used, thereby reducing output variability for constant inputs. FIG. 7A shows the relative magnitudes of typical grid drive voltages, in which $V_{g2-g1}$ is the voltage on G2 relative to the voltage on G1; $V_k$ is the cathode voltage; and, as aforementioned, $V_{dg}$ is the drive voltage and $V_{g1-k}$ is the cut off voltage. The broken line indicates the effect of reducing $V_{g2}$. Cut-off reduces and so does the drive voltage. FIG. 7B shows equivalent typical cathode drive voltages by way of comparison, in which $V_{g2-k}$ is the voltage between G2 and the cathode; $V_{k-g1}$ is the voltage on the cathode relative to the voltage on G1 (the cut-off voltage in this arrangement); and, $V_{dk}$ is the drive voltage applied to the cathode. FIG. 7C shows the relationship between the cut off voltage and $V_{g2-g1}$. If the voltage at G2 is expressed as $V_{g2-k}$, then the curve shown can be derived by adding $V_{k-g1}$. The gradient of the curve, or penetration factor D is given by:

$$D=\frac{dV_{k-g1}}{dV_{g2-g1}}$$

The beam current, $I_a$, is then given by:

$$I_a=\frac{\{(1+D)\cdot V_{dk}\}^3}{(V_c+D\cdot V_{dk})^{3/2}}$$

FIG. 8 shows typical performance curves for CRT 210. The broken lines indicate maximum and minimum tolerance limits. FIG. 8A shows a typical relationship between cut off voltage $V_{k-g1}$ and $V_{g2-g1}$. The heavy line indicates the operating range of G2. FIG. 8B shows a typical relationship between drive voltage $V_d$ and $V_{g2-g1}$. The heavy line indicates the operating range of G2 and the drive voltages for 100 V cut-off. FIG. 8C shows a typical relationship between spot diameter ratio and $V_{g2-g1}$.The heavy line again indicates the operating range of G2 voltages. FIG. 8D shows a typical relationship between spot area ratio and $V_{g2-g1}$. The heavy line once again shows the operating range of G2 voltages. Typically, during factory set of the display,. the G2 voltage is set to give a cut-off of 100 V. The heavy lines in FIGS. 8A to 8D show the actual range of G2 voltage that can occur after factory set up. G2 voltage can be reduced from this point to increase spot size. However, it will be appreciated from FIG. 8, that, if the G2 voltage reduced, the cut-off voltage and drive voltage should be correspondingly reduced to maintain constant beam current and picture brightness despite the change in spot size. It will also be appreciated from FIG. 8, and FIGS. 8C and 8D in particular, that, despite the relatively wide tolerance range, the relationships between spot diameter and $V_{g2-g1}$ and spot area and $V_{g2-g1}$ are similar in form.

FIG. 9 shows a typical relationship between spot diameter and focus voltage. In a typical colour CRT display, a reduction in G2 voltage of around 75 V, together with a reduction in Focus voltage of around 75 V, and corresponding reductions in G2 and drive voltages in accordance with the graphs of FIG. 8, provides an increase in spot diameter of the order of 25%. Referring back to FIG. 4, Moire interference produced in a VGA picture mode by a spot diameter of 0.7 mm can be reduced to below the 1.4% Barten visibility limit by a 14% increase in spot diameter to 0.8 mm via a reduction in focus and G2 voltages of 30 V.

Returning to FIG. 1, spot control circuit 120 receives inputs 130 and 140 from vertical and horizontal Moire interference detection circuits 110 respectively. In response to inputs 130 and 140, spot control circuit 120 generates outputs 150 and 160 to video amplifier 250 and EHT generator 230. In operation, output 150 the focus and G2 voltages generated by EHT generator 230 to be reduced over a limited range from the operating point set in the factory. Simultaneously, output 150 permits cut-off and drive drive voltages to be reduced as demonstrated in graphs of FIG. 8. It will be appreciated that spot control circuit 120 may be implemented by dedicated analogue electronic circuitry, by a combination of dedicated analogue and digital electronic circuitry, or by analogue electronic circuitry at least partially controlled by processor 270. The latter is preferred for simplicity.

Referring now to FIG. 10, EHT generator 230 typically comprises a step up transformer having a secondary winding for generating the extra high tension (typically 25 kV) in CRT 210. A bleed resistor chain (typically 500 Mohm) B1 is connected to the secondary winding from which the focus voltage (typically 6 kV) and the G2 voltage (typically between 400 V and 650 V) are tapped. Bleed chain B1 is terminated to ground typically through a relatively high (typically 1.7 Mohm) resistor R1. In a preferred embodiment of the present invention, the collector of a bipolar transistor T1 is connected to the junction of R1 and B1. The emitter of T1 is connected to ground via a 90K resistor R2. The base of T1 is connected to an output of processor 270. In operation, T1 and R2 provide microprocessor-controlled limited adjustment of and the focus and G2 voltages. The parameters of T2 and the value of R2 are preferably selected to provide adjustment of the G2 and focus voltage within an 80 V range for input range from processor 270 of 5 V. This is sufficient to permit of 25% increase in spot diameter for the worst case tolerance.

Returning again to FIG. 1, in preferred embodiments of the present invention, the cut-off and drive voltages are already set by processor 270. Limited variability of the focus and G2 can be added simply by introducing the circuit of FIG. 10. It will be appreciated that processor 270 can then be programmed with an appropriate algorithm or look up table to track all four voltages. It will also be appreciated that the setting of these four voltages can be either user-controlled via user control panel 260, or automatic on detection of Moire conditions in input video signals R, G and B. Manual control via user control 260 also permits the user to fine tune the focus of the picture according to personal preference.

What follows is a detailed description of Moire interference detectors 100 and 110. The following relates in general to the more complex case of detecting horizontal or video Moire interference. For vertical Moire interference on shadow-mask CRTs, the problem is a subset of the general case and various simplifications are possible. These simplifications will be discussed later. Note however that shadow mask CRTs suffer from both horizontal and vertical Moire interference and thus measures to deal with both of these may be employed.

As mentioned in the foregoing, in the general case, the presence of Moire interference depends on the CRT dot pitch and the pixel spacing. For a multi-frequency display with variable picture size driven by undefined graphics modes it thus extremely difficult, if not impossible, to design in Moire interference avoidance by traditional methods.

Equation 1 below predicts the critical pixel frequency for horizontal Moire interference for any mode on any CRT with any user setting of picture size. In the formula, $f_c$=critical pixel frequency; $W_s$ =picture or scan width; $T_{1a}$=active line time; and $P_{hd}$=horizontal dot pitch.

$$f_c = \frac{W_s}{T_{la} \cdot P_{hd}} \tag{1}$$

Horizontal Moire interference affects both aperture grille and shadow mask CRTs. Shadow mask CRTs also suffer from vertical Moire interference where the scanning electron beam spacing cause interference patterns with the shadow mask dot pitch.

Equation 2 below predicts the critical pixel frequency for vertical Moire interference for any mode on any CRT with any user setting of picture size. In equation (1), $f_1$=critical line frequency; $H_s$=picture or scan width; $T_{fa}$=active line time; and $P_{vd}$=horizontal dot pitch.

$$f_1 = \frac{H_s}{T_{fa} \times P_{vd}} \tag{2}$$

Determining the critical pixel frequency for horizontal Moire interference is relatively easy if the active line time, or alternatively the pixel clock frequency and the horizontal resolution, defining the operating mode is known. However, the display only has data relating to the sync frequency and the sync pulse duration. Typically, the display has no data relating to front and back porch times. A good estimate of active line time can be made from the line period by interpolating from many common video modes. FIG. 11 shows the relationship between "line utilisation" time and line frequency for a range of common video modes. A best fit curve is drawn through them. The line utilisation time is the active line time divided by the line period expressed as a percentage. The best fit curve permits a good prediction of the active line time to be interpolated for a given line frequency. Thus the active line time may be determined. The dot pitch is known for a particular CRT, and the scan width may be obtained buy monitoring the current in the horizontal deflection coils. Thus the critical pixel frequency may be found.

If the CRT has a non-linear dot pitch then it may be necessary to compensate the critical pixel frequency as a function of the dot pitch geometry. Typically, the phosphor dot spacing and size is greater at the periphery of the screen than at the centre. With reference to equation 1, the critical pixel frequency is thus lowest at the start and end of the active video period and passes through a maximum at the midpoint of the scan. The shape of the curve of critical pixel frequency versus scan position correlates to the CRT phosphor dot geometry. This applies equally in the horizontal and vertical directions.

Referring now to FIG. 12, an example of a horizontal Moire interference detector for a CRT display of the present invention comprises a summation block 310 for summing the input video signals R, G, and B. A frequency to voltage convertor 320 has an input connected to line sync signal HSYNC. Convertor 320 produces a voltage dependent on the frequency of line sync signal HSYNC. A sync voltage corrector 330 is connected to the output of convertor 320. Corrector 330 performs sync voltage correction in accordance with the relationship shown in FIG. 11. A peak detector 340 has an input connected to the line scan current. Detector 340 produces an output voltage proportional to the scan current and thus the scan width. A band-pass filter has a signal input connected to the output of summation block 310. Filter 360 has a centre frequency which may be varied according to a control input. The output of filter 360 is connected to a rectification and thresholding circuit 370. A phosphor dot geometry corrector 380 also has an input connected to the line sync signal. Geometry corrector 380 produces an output voltage to compensate the critical pixel frequency during the line scan period as the phosphor dot spacing changes. It will be appreciated, that in embodiments of the present invention in which phosphor dots are equally spaced, geometry corrector 380 may be omitted. An arithmetic function block 350 is connected to the outputs of the sync voltage corrector 330, geometry corrector 380, peak detector 340, and a horizontal Moire control 390 on user control panel 260. Block 350 provides scaling and division in accordance with equation 1 to produce the control input to filter 360. Control 390 permits fine tuning of horizontal Moire interference detection. Such tuning may be required in the event that, for example, an operating mode does not exactly lie on the best fit curve in the graph of FIG. 11 or where electron beam spot size variations allow a greater or lesser degree of spot control. Filter 360 may be implemented by what is generally referred to in the art as a "state variable bi-quad". The input to the filter is effectively the luminance signal produced by combining the input video signals R, G, and B. Summation of the input video signals R, G, and B to produce a luminance signal is well-described in the art, particulary in the context of television circuits. When video frequency components likely to cause Moire interference are detected, filter 360 produces an output. The output of filter 360 is rectified by rectification and thresholding circuit 370 to produce a binary output control signal at 395. Control signal 395 may then be used to configure drive circuitry 200 to control spot width, or height, or both, to reduce the Moire modulation depth to below a noticeable limit. Referring back to FIG. 2, in a preferred embodiment of the present invention, control signal 395 drives spot control circuit 120.

FIG. 4 mentioned above shows typical horizontal Moire modulation depth curves in relation to spot width. In many cases, a 15 per cent increase in spot width may totally eliminate Moire interference. The Barten visibility limit 85 for the curves is 1.4 per cent.

It will be realised that so far only the critical pixel frequency has been discussed in any detail, but that horizontal Moire interference is a progressive disturbance that does not occur at a single frequency. FIG. 3 shows a set of Moire interference curves for a typical CRT having an aperture grille pitch of 0.31 mm. Noticeable horizontal Moire interference will occur, given the correct video pattern, over a range of picture widths or resolutions. However, filter 360 is not an "ideal" filter with an infinitely steep amplitude response. This may be advantageously utilised in examples of the present invention to allow for system tolerances. The maximum centre frequency of filter 360 should be half of the dot clock frequency of the highest frequency video mode supported by the display. For a typical 21 inch CRT, the centre frequency of filter 360 should be variable up to 70 MHz.

The following two factors lead to a simplification of the filter design. Firstly, it is found in practice that horizonal Moire interference is more likely to occur in two conditions, corresponding to the N=2 and N=3 curves of FIG. 3. Secondly, the range over which the centre frequency of filter 360 should be variable is significantly less than the overall range of operating frequencies of the display. This is because, for all practical modes, the line frequencies producing an image which may cause horizontal Moire interference are at the high end of the line scan frequency band.

Band-pass filters can be regarded as oscillatory systems and have a finite response time. Thus, the response of the FIG. 12 arrangement to any frequency components of the input video signals R, G and B with potential to produce Moire interference is not instantaneous. However, for Moire interference to be visible, the Moire wavelength must be within the spatial resolution of the eye. Several pixels are required to achieve this, longer than the minimum response time of filter 360. The overall time constant of filter 360 and rectification and thresholding circuit 370 is tuned so that the turn off time is considerably faster than the turn on time. This avoids degradation, for instance, of text starting in a data window immediately after a dithered background with video components in the pass band of filter 360.

The example of the present invention hereinbefore described can be divided into two sections: a higher frequency video path; and a lower frequency adaptive control system. Referring now to FIG. 13, in a particularly preferred embodiment of the present invention, the video path is implemented by analogue circuitry and the control system is implemented by digital circuitry. It will be appreciated that filter 360 and thresholding circuit 370 may implemented by a single application specific integrated circuit (ASIC). In preferred embodiments of the present invention, the control system is implemented at least partially by processor 270 for simplicity. However, it will be appreciated that, in other embodiments of the present invention, the control system may be implemented by dedicated digital circuitry, analogue circuitry, or a combination of both digital and analogue circuitry. If phosphor dot geometry correction is required, it is preferable to recalculate the critical pixel frequency many times during each line period. This imparts a significant load to the processor. Therefore, it is preferable to include a separate analog multiplier to perform this function separately from processor 270.

Block 650, containing convertor 320 and corrector 330, can be omitted if the display has a display data channel (DDC) 600, such as the Video Electronics Standards Association (VESA) DDC, linked to a video adaptor 630 of a host computer 640. Display data channel 600 enables processor 270 to request the active line period from a host computer 640.

Referring back to FIG. 1, processor 270 already controls the deflection width through an interface to width control 620 in user control panel 260 and to line scan circuit 220; has user inputs itself; and has existing connections to convertor 320 for other functions. Thus, the individual functions of convertor 320, corrector 330, detector 380, and arithmetic function block 350 are already available in processor 270. In especially preferred embodiments of the present invention, these functions are combined by a microcode control routine within processor 270 to produce a single control output to filter 360. In these embodiments, an optimal Moire control point can also be beneficially saved by processor 270 for many commonly used display operating modes.

What follows is description of examples of vertical Moire interference detector 110 of Moire reduction apparatus of the present invention. It should be noted that vertical Moire interference occurs in displays having shadow mask CRTs and not in displays having aperture grille CRTs. Therefore, in displays having aperture grille CRTs, vertical Moire interference detector 110 can be omitted.

Referring now to FIG. 14, the vertical Moire interference detector comprises a frequency to voltage convertor 700 having an input connected to the frame sync signal VSYNC. The output of convertor 700 is connected to the input of a frame time corrector 720. The output of corrector 720 is connected to an input to an arithmetic function unit which is implemented, in particularly preferred embodiments of the present invention, by processor 270. A shadow mask compensator 710 also has an input connected to the frame sync signal VSYNC. The output of compensator 710 is also connected to an input of processor 270. A synchronous sine wave generator 740 has an input connected to the line sync signal HSYNC. The output of generator 740 is connected to the input of a variable centre frequency band pass filter 750. The output of filter 750 is connected to the input of a rectification and quantisation circuit 760. Quantisation circuit 760 has an output connected to a spot size control system in display circuitry 200. Filter 750 has a control input 790 connected to an output of processor 270. A height control 780 of user control panel 260 is connected to an input of processor 270. A vertical Moire control 780 in user control panel 260 is connected to an input of processor 270 to permit fine tuning of vertical Moire interference detection.

In vertical Moire interference detector 110, the active frame time is produced by corrector 720. If the display has the aforementioned display data channel 600, corrector 720 can be omitted because the active frame period can be obtained by processor 270 from the host computer 640 via the display data channel 600. Variable phosphor dot spacings are dealt with in vertical Moire interference detector 110 in the same manner as they are dealt with by the horizontal Moire interference detector 100.

In vertical Moire interference detector 110, the high frequency path receives the horizontal sync signal HSYNC. Horizontal sync signal HSYNC is a pulse train with a duty cycle and repetition rate dependent of the display mode. This signal, whilst of the correct frequency, is not preferred for direct analogue filtering. Therefore, waveform shaping is desirable. The preferred signal is a sine wave of constant amplitude and of a frequency equal to that of the frame sync signal. The desired signal is produced by generator 740 synchronised to the frame sync signal VSYNC. Generator 740 may comprise a phase locked loop. The desired signal is passed through filter 750. The centre frequency of filter 750 is set to the critical line rate via its control input and the corresponding output from processor 270. On detection of line sync pulses at the critical line rate, filter 750 passes the desired signal through to rectification and quantisation circuit 760. Circuit 760 produces a binary signal based on the signal passed by the filter for controlling spot control circuit 120.

The frequencies addressed by vertical Moire interference detector 110 are generally much lower than the frequency is addressed by horizontal Moire interference detector 100. Therefore, the related processing requirement is reduced. Where horizontal Moire interference detector 100 included a multiplier 610, the similar operation in vertical Moire interference detector 110 may be performed by software in processor 270 since the calculation is required only once at the start of each new line of data. Generator 740, filter 750, and rectification circuit 760 may conveniently be implemented in combination by a digital signal processor integrated circuit 770.

I claim:

1. Cathode ray tube display apparatus comprising: a cathode ray display tube in which an electron beam spot is scanned in a raster pattern to produce an output image; drive means for generating drive voltages on the focus electrode, first and second grid electrodes, and a cathode of the cathode ray tube to generate the electron beam spot in the cathode ray tube; spot size control means for simultaneously varying, in response to a spot control signal, the voltages generated on the focus electrode, first and second gird electrodes and the cathode by the drive means to vary the size of the electron beam spot in the cathode ray tube; and, Moire interference detection means comprising: a bandpass filter for generating the spot control signal in response to a signal indicative of the pixel freguency of a displayed image in a direction of raster scan falling within the pass band of the filter; and filter control means for varying the center frequency of the pass band of the filter in dependence on an active video period of the image in said direction of raster scan, the spacing of adjacent phosphor elements of the cathode ray display tube of the display in said direction of raster scan, and the scan size in said direction of raster scan.

2. Apparatus as claimed in claim 1, wherein the drive means comprises a potential divider of a transformer for generating the voltages on the focus electrode and the second grid electrode and the spot size control means comprises offset means responsive to the control signal for varying a bias applied to the potential divider to vary the voltages on the focus electrode and the second grid electrodes.

3. Apparatus as claimed in claim 2, wherein the offset means comprises a transistor for controlling the bias applied to the potential divider in response to the spot control signal.

4. Apparatus as claimed in claim 1, comprising a manually adjustable user control for generating the spot control signal to permit manual adjustment of the electron beam spot size.

5. Apparatus as claimed in claim 1, wherein the spot control signal comprises a binary signal, the apparatus comprising a thresholding circuit connected to the output of the filter for generating the binary signal.

6. Apparatus as claimed in claim 1, wherein the filter control means comprises an arithmetic function unit for generating a control signal for varying the center frequency of the filter according to the formula $$f=W/(T\times P),$$

where f is the control signal, W is the scan size, T is the active video period, and P is the phosphor element spacing.

7. Apparatus as claimed in claim 1, wherein the arithmetic function unit comprises a microprocessor.

8. Apparatus as claimed in claim 1, comprising determination means for determining the active video period from a raster synchronization signal corresponding to said direction of raster scan.

9. Apparatus as claimed in claim 8, wherein the determination means comprises: a frequency to voltage convertor for generating an output voltage level as a function of the frequency of the raster synchronization signal; and a corrector for generating a corrected voltage level indicative of the active video period in response to the output voltage level from the convertor.

10. Apparatus as claimed in claim 1, comprising a display data channel for communicating control data between the processor and a video source, the processor being configured to obtain the active line period from the video source via the display data channel.

11. Apparatus as claimed in claim 1, comprising scan detection means for determining the scan size as a function of a raster scan signal for scanning electron beams in the CRT in said direction of raster scan.

12. Apparatus as claimed in claim 1, wherein the direction of raster scan is parallel to the raster scan lines, the signal indicative of the pixel frequency is the input video signal, the active video period is the active line period, and the scan size is the length of the raster scan lines.

13. Apparatus as claimed in claim 11 or claim 12, wherein the arithmetic function unit comprises an analogue multiplier for determining the product of the active line period and the phosphor spacing.

14. Apparatus as claimed in claim 12, wherein the arithmetic function unit comprises an analog multiplier for determining the product of the active line period and the phosphor spacing.

15. Apparatus as claimed in claim 1, wherein the direction of raster scan is perpendicular to the raster scan lines, the signal indicative of the pixel frequency is the line synchronization signal, the active video period is the active field period, and the scan size is the length of the raster field.

16. Apparatus as claimed in claim 15, comprising a sine wave generator for generating a sine wave synchronized to the line synchronization signal for input to the bandpass filter.

17. A method for varying the size of an electron beam spot in a cathode ray tube display having a cathode ray display tube in which an electron beam spot is scanned in a raster pattern to produce an output image and drive means for generating drive voltages on the focus electrode, first and second grid electrodes, and a cathode of the cathode ray tube to generate the electron beam spot in the cathode ray tube; the method comprising simultaneously varying, in response to a spot control signal, the voltages generated on the focus electrode, first and second gird electrodes and the cathode.by the drive means; generating the spot control signal (395;790) in response to a signal indicative of the pixel frequency of a displayed image in a direction of raster scan falling within the pass band of a band-pass filter (360;750); and varying the centre frequency of the pass band of the filter in dependence on an active video period of the image in said direction of raster scan, the spacing of adjacent phosphor elements of the cathode ray display tube (210) of the display in said direction of raster scan, and the scan size in said direction of raster scan.

* * * * *